US012152324B2

(12) United States Patent
Wang et al.

(10) Patent No.: US 12,152,324 B2
(45) Date of Patent: Nov. 26, 2024

(54) CROSS-LINKED NON-WOVEN MAT

(71) Applicant: Owens Corning Intellectual Capital, LLC, Toledo, OH (US)

(72) Inventors: Xin Wang, Charlotte, NC (US); Paul Geel, Heveadorp (NL)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 17/765,617

(22) PCT Filed: Oct. 27, 2020

(86) PCT No.: PCT/US2020/057444

§ 371 (c)(1),
(2) Date: Mar. 31, 2022

(87) PCT Pub. No.: WO2021/086803

PCT Pub. Date: May 6, 2021

(65) Prior Publication Data

US 2022/0403570 A1 Dec. 22, 2022

Related U.S. Application Data

(60) Provisional application No. 62/926,650, filed on Oct. 28, 2019.

(51) Int. Cl.
*D04H 1/4218* (2012.01)
*D04H 1/587* (2012.01)
(Continued)

(52) U.S. Cl.
CPC ..... *D04H 1/643* (2013.01); *D04H 1/4218* (2013.01); *D04H 1/587* (2013.01); *D04H 1/724* (2013.01)

(58) Field of Classification Search
CPC ..... D04H 1/64; D04H 1/587; D04H 1/4218; D04H 1/724
See application file for complete search history.

(56) References Cited

U.S. PATENT DOCUMENTS 4,178,406 A 12/1979 Russell
5,932,689 A * 8/1999 Arkens ..... D04H 1/435 525/327.7

(Continued)

FOREIGN PATENT DOCUMENTS

EP 990727 A1 4/2000
EP 3299514 A1 3/2018

(Continued)

OTHER PUBLICATIONS

English translation to JP-2004-115956-A to Kawasaki et al. obtained from PE2E database. (Year: 2004).*

(Continued)

*Primary Examiner* — Jeremy R Pierce
(74) *Attorney, Agent, or Firm* — Calfee, Halter & Griswold LLP

(57) ABSTRACT

A cross-linked nonwoven fibrous mat is disclosed comprising a core layer including a fibrous precursor mat bound with a formaldehyde-free core binder composition and a cross-linker disposed on at least one surface of the core layer, said cross-linker comprising one or more of isocyanate, polyol, and melamine functional groups. The cross-linked nonwoven mat has a hot-wet retention of at least 25%.

8 Claims, 5 Drawing Sheets

(51) Int. Cl.
*D04H 1/64* (2012.01)
*D04H 1/724* (2012.01)

(56) References Cited

U.S. PATENT DOCUMENTS

| | | | | |
|---|---|---|---|---|
| 6,767,638 | B2 | 7/2004 | Samaranayake | |
| 7,851,542 | B2 | 12/2010 | Michl et al. | |
| 8,034,416 | B2 | 10/2011 | Dupre, Jr. et al. | |
| 8,133,952 | B2 | 3/2012 | Pisanova et al. | |
| 8,287,999 | B2 | 10/2012 | Schmidt et al. | |
| 8,426,632 | B2 | 4/2013 | Tanaka et al. | |
| 9,593,180 | B2 | 3/2017 | Jakob et al. | |
| 9,593,221 | B1 * | 3/2017 | Kurple | C08G 18/1833 |
| 2007/0059508 | A1 * | 3/2007 | Xing | D04H 1/64 428/292.1 |
| 2008/0230001 | A1 * | 9/2008 | Fugitt | D21H 23/56 118/258 |
| 2013/0183361 | A1 | 7/2013 | Tamareselvy et al. | |

FOREIGN PATENT DOCUMENTS

| | | | | |
|---|---|---|---|---|
| JP | 2004115956 | A | * | 4/2004 |
| JP | 2013079471 | A | | 5/2013 |
| JP | 2014205825 | A | | 10/2014 |
| WO | 2006120523 | A1 | | 11/2006 |
| WO | 2008008868 | A2 | | 1/2008 |
| WO | 2015084372 | A1 | | 6/2015 |
| WO | 2019111449 | A1 | | 6/2019 |

OTHER PUBLICATIONS

Lewis D. Shackford, "A Comparison of Pulping and Bleaching of Kraft Softwood and Eucalyptus Pulps," 36th International Pulp and Paper Congress and Exhibition (Year: 2003).*

English translation obtained from PE2E database for WO 2019/111449 to Goto et al. (Year: 2019).*

International Search Report and Written Opinion from PCT/US2020/057444 dated Feb. 1, 2021.

* cited by examiner

CROSS-LINKED NON-WOVEN MAT

CROSS-REFERENCE TO RELATED APPLICATIONS

This application is the U.S. national stage entry of PCT/US2020/057444, filed on Oct. 27, 2020, which claims priority to and all benefit of U.S. Provisional Patent Application No. 62/926,650, filed on Oct. 28, 2019, the entire contents of which are fully incorporated herein by reference.

FIELD

The present invention relates to cross-linked non-woven fibrous mats, and methods of manufacturing such cross-linked non-woven fibrous mats.

BACKGROUND

Fibrous non-woven mats are widely used in the building materials industry in insulation applications, as facing materials for laminated articles such as foam composites and gypsum boards, and as roofing materials. Roofing materials, such as shingles, roll roofing, and commercial roofing, are typically constructed of a glass fiber mat, an asphalt coating on the fibrous mat, and a surface layer of granules embedded in the asphalt coating.

Fibrous non-woven mats suitable for use in the building materials industry generally include glass fibers because they are of high strength and tend not to shrink during use. The glass fibers are bound together with an adhesive binder composition, forming a fiberglass non-woven mat. Adhesive binder compositions useful in the production of nonwoven fiber mats generally require a low viscosity in the uncured state yet are able to form a semi-rigid or rigid mat for the fibers when cured. Historically, urea-formaldehyde ("UF") binders were typically utilized for roofing applications due to its low cost, compatibility with asphalt, and resulting high strength. However, due to environmental concerns caused by the emission of formaldehyde, a number of formaldehyde-free binder compositions have been developed for use as a binder for making various non-woven products.

Properties such as tear strength, dry tensile strength, and hot-wet tensile strength are measured to determine the usefulness of the fiberglass non-woven mat in building material applications. One especially important property is the retention of hot-wet tensile strength. The hot-wet tensile strength provides an estimation of the durability of the roofing mat. However, nonwoven fiber mats formed using formaldehyde-free binders may lack certain desired performance or properties, as they may be susceptible to moisture absorption, which leads to the hot-wet tensile performance to be below the requirements for roofing mats.

Accordingly, there remains a need for formaldehyde-free (or no added formaldehyde) non-woven fiber mats with improved hot-wet tensile strength retention, while maintaining adequate tensile and tear strengths.

SUMMARY

In accordance with various aspects of the present inventive concepts, a cross-linked nonwoven fibrous mat is disclosed that includes a core layer including a precursor mat comprising a plurality of fibers bound with a formaldehyde-free core binder composition. The binder composition includes hydroxyl or carboxylic acid functional groups and a cross-linker disposed on at least one surface of the core layer. The cross-linker comprises one or more of isocyanate, polyol, and melamine functional groups. The cross-linked nonwoven mat has a hot-wet retention of at least 25%.

The plurality of fibers may comprise one or more of glass fibers, carbon fibers, mineral fibers, ceramic fibers, natural fibers, and synthetic fibers.

In any of the exemplary embodiments, the core binder composition may comprise a polyhydroxy component that is present in an amount from about 30% to about 95% by weight, based on the weight of the total solids in the binder composition.

The cross-linker may be selected from the group consisting of toluene diisocyanate (TDI), isocyanurates of toluene diisocyanate, diphenylmethane 4,4'-diisocyanate, isocyanurates of 4,4'-diisocyanate, methylenebis-4,4'-isocyanatocyclohexane, isophorone diisocyanate, isocyanurates of isophorone diisocyanate, 1,6-hexamethylene diisocyanate, isocyanurates of 1,6-hexamethylene diisocyanate, 1,4-cyclohexane diisocyanate, p-phenylene diisocyanate, and triphenylmethane 4,4',4"-triisocyanate, tetramethyl xylene diisocyanate, metaxylene diisocyanate, and polyisocyanates. In any of the embodiments, the cross-linker may be selected from the group consisting of polyvinyl alcohol, polyester polyols, and polyether polyols. In yet other embodiments, the cross-linker is selected from the group consisting of methylated melamine, mixed ether melamine, and butylated melamine.

In any of the exemplary embodiments, the cross-linker may be present in an amount no greater than 5.0 $g/m^2$, such as in an amount between about 0.005 $g/m^2$ and about 5.0 $g/m^2$, or between about 0.05 $g/m^2$ and about 1.0 $g/m^2$.

In these or other embodiments, the core binder composition and secondary binder composition provide a total binder weight between about 4.0-25.0 $g/m^2$.

In these or other embodiments, the cross-linked nonwoven mat has a hot-wet retention of at least 30%, including at least 33%, 34%, and 35%.

In accordance with other aspects of the present inventive concepts, a cross-linked nonwoven fibrous mat is provided that includes a core layer including a precursor mat comprising a plurality of fibers bound with a hydrophobic core binder composition having hydroxyl or carboxylic acid functional groups; and a protective coating layer comprising a cross-linker, disposed on at least one surface of the core layer. The cross-linker comprises one or more of isocyanate, polyol, and melamine functional groups. The cross-linked nonwoven mat has a hot-wet retention of at least 50%.

In any of the exemplary embodiments, the protective coating may further include about 70 wt. % to about 90 wt. % of a secondary binder and about 5 wt. % to about 30 wt. % of the cross-linker.

The protective coating composition may further include water repellant additives.

The cross-linker may be selected from the group consisting of toluene diisocyanate (TDI), isocyanurates of toluene diisocyanate, diphenylmethane 4,4'-diisocyanate, isocyanurates of 4,4'-diisocyanate, methylenebis-4,4'-isocyanatocyclohexane, isophorone diisocyanate, isocyanurates of isophorone diisocyanate, 1,6-hexamethylene diisocyanate, isocyanurates of 1,6-hexamethylene diisocyanate, 1,4-cyclohexane diisocyanate, p-phenylene diisocyanate, and triphenylmethane 4,4',4"-triisocyanate, tetramethyl xylene diisocyanate, metaxylene diisocyanate, and polyisocyanates. In other embodiments, the cross-linker is selected from the group consisting of polyvinyl alcohol, polyester polyols, and polyether polyols. In yet other embodiments, the cross-linker is selected from the group consisting of methylated melamine, mixed ether melamine, and butylated melamine.

In these or other embodiments, the cross-linked nonwoven mat has a hot-wet retention of at least 55%, including at least 60%, 63%, and 65%.

In accordance with yet further aspects of the present inventive concepts, a method for forming a cross-linked non-woven fibrous mat is disclosed. The method includes forming a core layer by dispersing a plurality of fibers in a white-water solution to form a fiber slurry, depositing the fiber slurry onto a conveying apparatus, and removing the water from the slurry, forming a fiber web. The method further includes applying a formaldehyde-free core binder composition onto the fiber web and curing the web and applying a cross-linker on at least one surface of the core layer. The cross-linker comprises one or more of isocyanate, polyol, and melamine functional groups and the formaldehyde-free core binder composition has hydroxyl or carboxylic acid functional groups. The cross-linked nonwoven mat has a hot-wet retention of at least 25%.

Other aspects and features of the general inventive concepts will become more readily apparent to those of ordinary skill in the art upon review of the following description of various exemplary embodiments in conjunction with the accompanying figures.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Figure 1:
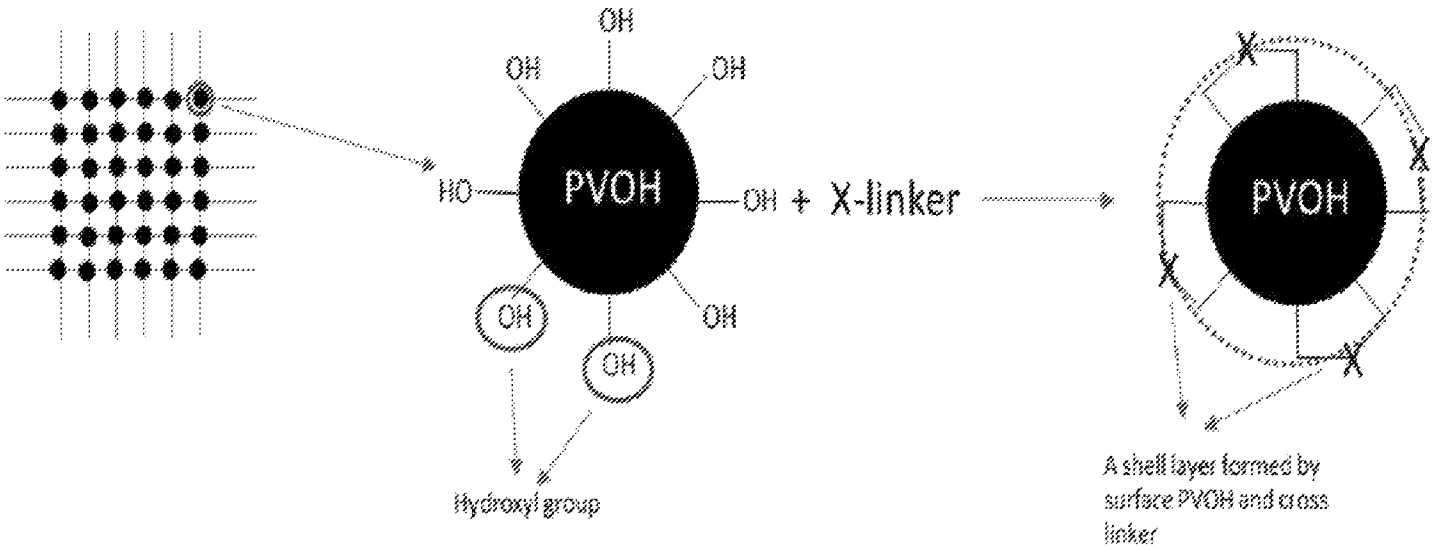
FIG. 1 shows an illustration of one exemplary aspect of the core/shell binder combination, in principle.

Unless otherwise defined, all technical and scientific terms used herein have the same meaning as commonly understood by one of ordinary skill in the art to which this application pertains. Although other methods and materials similar or equivalent to those described herein may be used in the practice or testing of the exemplary embodiments, exemplary suitable methods and materials are described below. In case of conflict, the present specification including definitions will control. In addition, the materials, methods, and examples are illustrative only and not intended to be limiting of the general inventive concepts.

The terminology as set forth herein is for description of the exemplary embodiments only and should not be construed as limiting the application as a whole. Unless otherwise specified, "a," "an," "the," and "at least one" are used interchangeably. Furthermore, as used in the description of the application and the appended claims, the singular forms "a," "an," and "the" are inclusive of their plural forms, unless contradicted by the context surrounding such.

Unless otherwise indicated, all numbers expressing quantities used in the specification and claims are to be understood as being modified in all instances by the term "about." The term "about" means within +/−10% of a value, or in some instances, within +/−5% of a value, and in some instances within +/−1% of a value.

To the extent that the term "includes" or "including" is used in the description or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." Thus, use of the term "or" herein is the inclusive, and not the exclusive use.

By "substantially free" it is meant that a composition includes less than 1.0 wt. % of the recited component, including no greater than 0.8 wt. %, no greater than 0.6 wt. %, no greater than 0.4 wt. %, no greater than 0.2 wt. %, no greater than 0.1 wt. %, and no greater than 0.05 wt. %. In any of the exemplary embodiments, "substantially free" means that a composition includes no greater than 0.01 wt. % of the recited component.

Unless otherwise indicated, any element, property, feature, or combination of elements, properties, and features, may be used in any embodiment disclosed herein, regardless of whether the element, property, feature, or combination of elements, properties, and features was explicitly disclosed in the embodiment. It will be readily understood that features described in relation to any particular aspect described herein may be applicable to other aspects described herein provided the features are compatible with that aspect. In particular: features described herein in relation to the method may be applicable to the fibrous product and vice versa; features described herein in relation to the method may be applicable to the aqueous binder composition and vice versa; and features described herein in relation to the fibrous product may be applicable to the aqueous binder composition and vice versa.

Every numerical range given throughout this specification and claims will include every narrower numerical range that falls within such broader numerical range, as if such narrower numerical ranges were all expressly written herein.

The general inventive concepts are based, in part, on the discovery that the addition of a small amount of a cross-linker or cross-linkable coating composition to a fibrous non-woven mat can improve mat performance properties and protect the mat from abrasion, chemical/humidity attack, and sunlight exposure.

The general inventive concepts further relate to a fibrous non-woven mat formed with a formaldehyde-free binder composition, while having improved properties. In some exemplary embodiments, the fibrous non-woven mat demonstrates improved mechanical strength, such as hot-wet tensile strength, due to reduced moisture absorption. The improved hot-wet tensile strength of the fibrous non-woven mats facilitate its use in roofing and related applications.

Suitable fibers for use in the non-woven mat include, but are not limited to, glass fibers, carbon fibers, mineral fibers such as mineral wool and rock wool, ceramic fibers, natural fibers, and/or synthetic fibers. The glass fibers can be made from any type of glass. Examples of glass fibers include A-type glass fibers, C-type glass fibers, E-type glass fibers, H-type glass fibers, S-type glass fibers, ECR-type glass fibers (e.g., Advantex® glass fibers commercially available from Owens Corning), Hiper-tex™ glass fibers, wool glass fibers, and combinations thereof. Natural fibers are plant fibers extracted from any part of a plant, including, but not limited to, the stem, seeds, leaves, roots, or phloem. Examples of natural fibers which may be suitable for use as the reinforcing fiber material include basalt, cotton, jute, bamboo, ramie, bagasse, hemp, coir, linen, kenaf, sisal, flax, henequen, and combinations thereof. Synthetic fibers are man-made fiber having suitable reinforcing characteristics, such as polyester, polyethylene, polyethylene terephthalate, polypropylene, polyamide, aramid, and polyaramid fibers, as well as combinations thereof.

In any of the exemplary embodiments, the fiber may have an average diameter between about 0.5 microns and about 24 microns. In these or other embodiments, the fibers may have an average diameter of about 3 microns to about 20 microns, in other embodiments of about 5 microns to about 16 microns, in other embodiments of about 6.5 microns to about 16 microns, in other embodiments of about 8 microns to about 15 microns, and in other embodiments of about 10 microns to about 14 microns. In any of the exemplary embodiments, where the fibers are chopped fibers, the fibers may be described by the average length of the fibers. In these or other embodiments, the fibers may have an average length of about 4 millimeters to about 32 millimeters, in other embodiments of about 8 millimeters to about 28 millimeters, and in other embodiments of about 16 millimeters to about 24 millimeters.

Glass fibers may be formed by conventional methods known to those skilled in the art. For example, the glass fibers may be formed by a continuous manufacturing process in which molten glass passes through the holes of a "bushing," the streams of molten glass thereby formed are solidified into filaments, and the filaments are combined together to form a fiber, "roving," "strand," or the like.

After the glass fibers are drawn from the bushing, an aqueous sizing composition (also referred to as a size) may optionally be applied to the fibers. The sizing composition is not limited, and may be any sizing known to those of skill in the art. Generally sizing compositions contain a lubricant to protect the fibers from damage by abrasion. The sizing composition may be applied by conventional methods such as by an application roller or by spraying the size directly onto the fibers. The size protects the glass fibers from breakage during subsequent processing, helps to retard inter-filament abrasion, ensures the integrity of the strands of glass fibers, promotes the interconnection of the glass filaments that form the strand, etc. After the glass fibers are treated with the sizing composition, they may be chopped for subsequent processing into a fibrous non-woven mat.

Fibrous non-woven mats generally comprise randomly matted fibers bonded together by a cured thermoset or dried thermoplastic polymeric binder. The processes for forming such mats are generally well known, including for example, the well-known wet-laid processing and dry-laid processing methods. During the wet-laid process, chopped glass fibers are provided to a conveying apparatus, such as a conveyor, by a storage container for conveyance to a mixing tank that may contain a white-water solution (e.g., various surfactants, viscosity modifiers, defoaming agents, and/or other chemical agents) with agitation to disperse the fibers and form a chopped glass fiber slurry. The glass fiber slurry may then be transferred to a head box where the slurry is deposited onto a conveying apparatus, such as a moving screen or conveyor, and a substantial portion of the water from the slurry is removed to form a web (mat) of enmeshed fibers. The water may be removed from the web by a conventional vacuum or air suction system.

A binder composition is then applied to the web by a suitable binder applicator, such as, for example, a spray applicator, curtain coater, or other means. Once the binder composition has been applied to the mat, the binder coated mat may be passed through at least one drying oven to remove any remaining water and cure the binder composition. The formed non-woven fiber mat that emerges from the oven is an assembly of randomly oriented, dispersed, individual glass fibers. The fiber mat may be rolled onto a take-up roll for storage or later use.

A dry-laid process is a process in which fibers are chopped and air blown onto a conveyor, after which a binder is then applied and cured to form the mat.

Suitable binder compositions useful in the nonwoven fiber mats include formaldehyde-free (or no-added formaldehyde) binders comprising cross-linkable functionalities, including hydroxyl or carboxylic acid groups. In some exemplary embodiments, the binder composition includes a polyhydroxy component having at least two hydroxyl groups, such as polyvinyl alcohol, a carbohydrate, and the like. Such binders are free of added formaldehyde and are environmentally friendly, i.e., "green."

In any of the exemplary embodiments, the polyhydroxy component may comprise one or more of polyvinyl alcohol, polyvinyl acetate (partially or fully hydrolyzed), or mixtures thereof. Illustratively, when a partially hydrolyzed polyvinyl acetate serves as the polyhydroxy component, an 80%->99% hydrolyzed polyvinyl acetate may be utilized, such as, for example Poval® 385 (Kuraray America, Inc.) and Sevol™ 502 (Sekisui Specialty Chemicals America, LLC), both of which are about 85% (Poval® 385) and 88% (Selvol™ 502) hydrolyzed. Other options for the 88% hydrolyzed grade are: Poval® 3-88, Poval® 4-88, Poval® 8-88 and Poval® 13-88.

In any of the exemplary embodiments, the polyhydroxy component may comprise a carbohydrate-based binder composition. The carbohydrate may be natural in origin and derived from renewable resources. For instance, the carbohydrate may be derived from plant sources such as legumes, maize, corn, waxy corn, sugar cane, milo, white milo, potatoes, sweet potatoes, tapioca, rice, waxy rice, peas, sago, wheat, oat, barley, rye, amaranth, and/or cassava, as well as other plants that have a high starch content. The carbohydrate may also be derived from crude starch-containing products derived from plants that contain residues of proteins, polypeptides, lipids, and low molecular weight carbohydrates. The carbohydrate may be selected from monosaccharides (e.g., xylose, glucose, and fructose), disaccharides (e.g., sucrose, maltose, and lactose), oligosaccharides (e.g., glucose syrup and fructose syrup), and polysaccharides and water-soluble polysaccharides (e.g., pectin, dextrin, maltodextrin, starch, modified starch, and starch derivatives).

The carbohydrate may comprise a polymer having a number average molecular weight from about 1,000 to about 8,000. Additionally, the carbohydrate polymer may have a dextrose equivalent (DE) number from 2 to 20, from 7 to 11, or from 9 to 14. The carbohydrates beneficially have a low viscosity and cure at moderate temperatures (e.g., 80-250° C.) alone or with additives. The low viscosity enables the carbohydrate to be utilized in a binder composition. In any of the exemplary embodiments, the viscosity of the carbohydrate may be lower than 500 cps at 50% concentration and between 20 and 30° C.

In any of the exemplary embodiments, the carbohydrate may be a water-soluble polysaccharide such as dextrin or maltodextrin.

The polyhydroxy component may be present in the binder composition in an amount from about 30% to about 95% by weight, or from about 35% to about 75% by weight, or from about 40% to about 70% by weight, or from about 42% to about 65% by weight. As used herein, % by weight indicates % by weight of the total solids in the binder composition.

The binder composition may further include one or more crosslinking agents. The crosslinking agent may be any compound suitable for crosslinking the polyhydroxy component. In exemplary embodiments, the crosslinking agent has a number average molecular weight greater than 90, from about 90 to about 100,000, or from about 190 to about 10,000. In some exemplary embodiments, the crosslinking agent has a number average molecular weight less than about 4,000. Non-limiting examples of suitable crosslinking agents include polycarboxylic acids (and salts thereof), anhydrides, monomeric and polymeric polycarboxylic acid with anhydride (i.e., mixed anhydrides), phosphinopolycarboxylic acid, citric acid (and salts thereof, such as ammonium citrate), 1,2,3,4-butane tetracarboxylic acid, adipic acid (and salts thereof), polyacrylic acid (and salts thereof), and polyacrylic acid-based resins. Exemplary crosslinking agents include QXRP 1734, QR-1629S, Aquaset™ 100, Acumer™ 4161, and Acumer™ 9932, commercially available from The Dow Chemical Company; Joncryl® 1982, Joncryl® 1987, Joncryl® 2970, Joncryl® 8383 and Luhydran® A 848 S, commercially available from BASF; Plextol BV 411, Plextol DV 455 and Plextol DV 585, commercially available from Synthomer. Acumer™ 9932 is a polyacrylic acid/sodium hypophosphite resin having a molecular weight of about 4000 and a sodium hypophosphite content of 6-7% by weight. QR-1629S is a polyacrylic acid/glycerin mixture.

The crosslinking agent may be any monomeric or polymeric polycarboxylic acid, citric acid, and their corresponding salts, and mixtures thereof.

The crosslinking agent may be present in the binder composition in an amount up to about 70% by weight of the total solids in the binder composition. In any of the exemplary embodiments, the crosslinking agent(s) may be present in the binder composition in an amount from about 0.1% to about 65% by weight of the total solids in the binder composition, or from about 5% to about 60% by weight, from about 25% to about 58% by weight, or from about 35% to about 57% by weight.

Optionally, the binder composition may include a catalyst to assist in the crosslinking. The catalyst may include inorganic salts, Lewis acids (i.e., aluminum chloride or boron trifluoride), Bronsted acids (i.e., sulfuric acid, p-toluenesulfonic acid and boric acid) organometallic complexes (i.e., lithium carboxylates, sodium carboxylates), and/or Lewis bases (i.e., polyethyleneimine, diethylamine, or triethylamine). Additionally, the catalyst may include an alkali metal salt of a phosphorous-containing organic acid; in particular, alkali metal salts of phosphorus acid, hypophosphorus acid, or polyphosphoric Examples of such phosphorus catalysts include, but are not limited to, sodium hypophosphite, sodium phosphate, potassium phosphate, disodium pyrophosphate, tetrasodium pyrophosphate, sodium tripolyphosphate, sodium hexamethaphosphate, potassium phosphate, potassium tripolyphosphate, sodium trimetaphosphate, sodium tetramethaphosphate, and mixtures thereof. In addition, the catalyst or cure accelerator may be a fluoroborate compound such as fluoroboric acid, sodium tetrafluoroborate, potassium tetrafluoroborate, calcium tetrafluoroborate, magnesium tetrafluoroborate, zinc tetrafluoroborate, ammonium tetrafluoroborate, and mixtures thereof. Further, the catalyst may be a mixture of phosphorus and fluoroborate compounds. Other sodium salts such as, sodium sulfate, sodium nitrate, sodium carbonate may also or alternatively be used as the catalyst/accelerator. The catalyst or cure accelerator may be present in the binder composition in an amount from about 0% to about 10% by weight of the total solids in the binder composition, or from about 0.5% to about 6.0% by weight, or from about 1.0% to about 5.5% by weight.

The binder composition may optionally contain at least one coupling agent. In at least one exemplary embodiment, the coupling agent is a silane coupling agent. The coupling agent(s) may be present in the binder composition in an amount from about 0.001% to about 5.0% by weight of the total solids in the binder composition, from about 0.005% to about 2.5% by weight, or from about 0.1% to about 1.0% by weight.

Non-limiting examples of silane coupling agents that may be used in the binder composition may be characterized by the functional groups alkyl, aryl, amino, epoxy, vinyl, methacryloxy, ureido, isocyanato, and mercapto. In any of the exemplary embodiments, the silane coupling agent(s) may include silanes containing one or more nitrogen atoms that have one or more functional groups such as amine (primary, secondary, tertiary, and quaternary), amino, imino, amido, imido, ureido, or isocyanato. Specific, non-limiting examples of suitable silane coupling agents include, but are not limited to, aminosilanes (e.g., 3-aminopropyl-triethoxysilane and 3-aminopropyl-trihydroxysilane), epoxy trialkoxysilanes (e.g., 3-glycidoxypropyltrimethoxysilane and 3-glycidoxypropyltriethoxysilane), methyacryl trialkoxysilanes (e.g., 3-methacryloxypropyltrimethoxysilane and 3-methacryloxypropyltriethoxysilane), hydrocarbon trialkoxysilanes, amino trihydroxysilanes, epoxy trihydroxysilanes, methacryl trihydroxy silanes, and/or hydrocarbon trihydroxysilanes. In one or more exemplary embodiment, the silane is an aminosilane, such as γ-aminopropyltriethoxysilane.

In any of the exemplary embodiments, the binder composition may include a process aid (e.g., polyol) in addition to the carbohydrates described above. The process aid is not particularly limiting so long as the process aid functions to facilitate the processing of the fibers formation and orientation. The process aid can be used to improve binder application distribution uniformity, to reduce binder viscosity, to increase ramp height after forming, to improve the vertical weight distribution uniformity, and/or to accelerate binder de-watering in both forming and oven curing process. The process aid may be present in the binder composition in an amount from about 0% to about 25.0% by weight, from about 1.0% to about 20.0% by weight, or from about 5.0% to about 15.0% by weight.

Examples of processing aids include viscosity modifiers (e.g., glycerol, 1,2,4-butanetriol, 1,4-butanediol, 1,2-propanediol, 1,3-propanediol, poly(ethylene glycol) and defoaming agents (e.g., emulsions and/or dispersions of mineral, paraffin, or vegetable oils, dispersions of polydimethylsiloxane (PDMS) fluids and silica which has been hydrophobized with polydimethylsiloxane or other materials, and particles made of amide waxes such as ethylenebisstearamide (EBS) or hydrophobized silica). A further process aid that may be utilized in the binder composition is a surfactant. One or more surfactant may be included in the binder composition to assist in binder atomization, wetting, and interfacial adhesion.

The surfactant is not particularly limited, and includes surfactants such as, but not limited to, ionic surfactants (e.g., sulfate, sulfonate, phosphate, and carboxyl ate); sulfates (e.g., alkyl sulfates, ammonium lauryl sulfate, sodium lauryl sulfate (SDS), alkyl ether sulfates, sodium laureth sulfate, and sodium myreth sulfate); amphoteric surfactants (e.g., alkylbetaines such as lauryl-betaine); sulfonates (e.g., dioctyl sodium sulfosuccinate, perfluorooctanesulfonate, perfluorobutanesulfonate, and alkyl benzene sulfonates); phosphates (e.g., alkyl aryl ether phosphate and alkyl ether phosphate); carboxylates (e.g., alkyl carboxylates, fatty acid salts (soaps), sodium stearate, sodium lauroyl sarcosinate, carboxylate fluorosurfactants, perfluoronanoate, and perfluorooctanoate); cationic (alkylamine salts such as laurylamine acetate); pH dependent surfactants (primary, secondary or tertiary amines); permanently charged quaternary ammonium cations (e.g., alkyltrimethylammonium salts, cetyl trimethylammonium bromide, cetyl trimethylammonium chloride, cetylpyridinium chloride, and benzethonium chloride); and zwitterionic surfactants, quaternary ammonium salts (e.g., lauryl trimethyl ammonium chloride and alkyl benzyl dimethylammonium chloride), and polyoxyethylenealkylamines.

Suitable nonionic surfactants that can be used in conjunction with this invention include polyethers (e.g., ethylene oxide and propylene oxide condensates, which include straight and branched chain alkyl and alkaryl polyethylene glycol and polypropylene glycol ethers and thioethers); alkylphenoxypoly(ethyleneoxy)ethanols having alkyl groups containing from about 7 to about 18 carbon atoms and having from about 4 to about 240 ethyleneoxy units (e.g., heptylphenoxypoly(ethyleneoxy) ethanols, and nonylphenoxypoly(ethyleneoxy) ethanols); polyoxyalkylene derivatives of hexitol including sorbitans, sorbides, mannitans, and mannides; partial long-chain fatty acids esters (e.g., polyoxyalkylene derivatives of sorbitan monolaurate, sorbitan monopalmitate, sorbitan monostearate, sorbitan tristearate, sorbitan monooleate, and sorbitan trioleate); condensates of ethylene oxide with a hydrophobic base, the base being formed by condensing propylene oxide with propylene glycol; sulfur containing condensates (e.g., those condensates prepared by condensing ethylene oxide with higher alkyl mercaptans, such as nonyl, dodecyl, or tetradecyl mercaptan, or with alkylthiophenols where the alkyl group contains from about 6 to about 15 carbon atoms); ethylene oxide derivatives of long-chain carboxylic acids (e.g., lauric, myristic, palmitic, and oleic acids, such as tall oil fatty acids); ethylene oxide derivatives of long-chain alcohols (e.g., octyl, decyl, lauryl, or cetyl alcohols); and ethylene oxide/propylene oxide copolymers.

In at least one exemplary embodiment, the surfactants comprise one or more of SURFONYL® 420, SURFONYL® 440, and SURFONYL® 465, which are ethoxylated 2,4,7,9-tetramethyl-5-decyn-4,7-diol surfactants (commercially available from Air Products and Chemicals, Inc. (Allentown, Pa.)), Stanfax (a sodium lauryl sulfate), Surfynol 465 (an ethoxylated 2,4,7,9-tetramethyl 5 decyn-4,7-diol), Triton™ GR-PG70 (1,4-bis(2-ethylhexyl) sodium sulfosuccinate), and Triton™ CF-10 (poly(oxy-1,2-ethanediyl), alpha-(phenylmethyl)-omega-(1,1,3,3-tetramethylbutyl)phenoxy). The surfactant may be present in the binder composition in an amount from 0.0% to about 10% by weight of the total solids in the binder composition, from about 0.01% to about 10% by weight, or from about 0.2% to about 5.0% by weight.

The binder composition may optionally include a corrosion inhibitor to reduce or eliminate any potential corrosion to the process equipment. The corrosion inhibitor can be chosen from a variety of agents, such as, for example, hexamine, benzotriazole, phenylenediamine, dimethylethanolamine, polyaniline, sodium nitrite, benzotriazole, dimethylethanolamine, polyaniline, sodium nitrite, cinnamaldehyde, condensation products of aldehydes and amines (imines), chromates, nitrites, phosphates, hydrazine, ascorbic acid, tin oxalate, tin chloride, tin sulfate, thiourea, zinc oxide, and nitrile. Alternatively, the corrosion can be reduced or eliminated by process control abatement, such as process water neutralization, removal of corrosive ingredients, and process water treatment to minimize the corrosivity. The corrosion inhibitor may be present in the binder composition in an amount from about 0% to about 15.0% by weight, from about 1.0% to about 5.0% by weight, or from about 0.2% to about 1.0% by weight.

Also, the binder composition may also contain one or more biocide such as 3-iodo-2propyl-n-butylcarbamate, carbamic acid, butyl-, 3-iodo-2-propynyl ester (IPBC), 2-bromo-2-nitropropane-1,3-diol, magnesium nitrate, 5-chloro-2-methyl-4-isothiazolin-3-one, magnesium chloride, sulfamic acid, N-bromo, sodium salt, diiodomethyl-p-tolysulfone, dibromoacetonitrile, and 2,2-dibromo-3-nitrilopropionamide to reduce or eliminate mold and fungal growth on the fiberglass product. The biocide may be present in the binder composition in an amount from about 0% to about 10.0% by weight, from about 0.05% to about 1.0% by weight, or from 0.1% to about 0.5% by weight.

The binder may also include organic and/or inorganic acids and bases in an amount sufficient to adjust the pH to a desired level. The pH may be adjusted depending on the intended application, or to facilitate the compatibility of the ingredients of the binder composition. In exemplary embodiments, the pH adjuster may be utilized to adjust the pH of the binder composition to an acidic pH. Examples of suitable acidic pH adjusters include inorganic acids such as, but not limited to sulfuric acid, phosphoric acid and boric acid and also organic acids like p-toluenesulfonic acid, mono- or polycarboxylic acids, such as, but not limited to, citric acid, acetic acid and anhydrides thereof, adipic acid, oxalic acid, and their corresponding salts. Also, inorganic salts that can be acid precursors. The acid adjusts the pH, and in some instances, as discussed above, acts as a crosslinking agent. Optionally, organic and/or inorganic bases, such sodium hydroxide, ammonium hydroxide, and diethylamine, and any kind of primary, secondary, or tertiary amine (including alkanol amine), can be used for pH adjustment. The pH of the binder composition, when in an acidic state, may range from about 1 to about 6, and in some exemplary embodiments, from about 2 to about 5, including all amounts and ranges in between. In at least one exemplary embodiment, the pH of the binder composition is about 2.5. The pH adjuster in an acidic binder composition may be present in the binder composition in an amount sufficient to obtain the desired pH.

Additionally, the binder may contain a dust suppressing agent to reduce or eliminate the presence of inorganic and/or organic particles which may have adverse impact in the subsequent fabrication and installation of the insulation materials. The dust suppressing agent can be any conventional mineral oil, mineral oil emulsion, natural or synthetic oil, bio-based oil, or lubricant, such as, but not limited to, silicone and silicone emulsions, polyethylene glycol, as well as any petroleum or non-petroleum oil with a high flash point to minimize the evaporation of the oil inside the oven.

The binder may optionally contain conventional additives such as, but not limited to dyes, pigments, fillers, colorants, UV stabilizers, thermal stabilizers, anti-foaming agents, anti-oxidants, emulsifiers, preservatives (e.g., sodium benzoate), corrosion inhibitors, and mixtures thereof. Other additives may be added to the binder composition for the improvement of process and product performance. Such additives include lubricants, wetting agents, surfactants, antistatic agents, and/or water-repellent agents. Additives may be present in the binder composition from trace amounts (such as <about 0.1% by weight the binder composition) up to about 10.0% by weight of the total solids in the binder composition. In any of the exemplary embodiments, the additives may be present in an amount from about 0.1% to about 5.0% by weight of the total solids in the binder composition, from about 1.0% to about 4.0% by weight, or from about 1.5% to about 3.0% by weight.

The binder further includes water to dissolve or disperse the active solids for application onto the fibers. Water may be added in an amount sufficient to dilute the aqueous binder composition to a viscosity that is suitable for its application to the fibers and to achieve a desired solids content on the fibers. In particular, the binder composition may contain water in an amount from about 50% to about 98.0% by weight of the total weight of the binder composition.

One challenge with hydroxyl or carboxylic acid-based binder compositions is the relatively high moisture absorption of the binders, which causes the non-woven mats formed using such binders to have hot-wet retention values below the requirements for some applications, including roofing mat applications.

Thus, it has been surprisingly discovered that the separate application of a cross-linker to the fibrous non-woven mat creates a protective coating layer (or "shell layer") over the core binder containing non-woven mat (or "core layer"). The hydroxyl or carboxylic acid groups on the outside layer of the core binder cross-link with the cross-linker in the coating, creating a protective shell around the coated mat and providing protection against scratch/abrasion, chemical/humidity attach, etc.

In any of the exemplary embodiments, the cross-linker comprises one or more cross-linkable functional groups, such as isocyanate, polyol, and melamine. Examples of isocyanate cross-linkers include toluene diisocyanate (TDI), isocyanurates of toluene diisocyanate, diphenylmethane 4,4'-diisocyanate, isocyanurates of 4,4'-diisocyanate, methylenebis-4,4'-isocyanatocyclohexane, isophorone diisocyanate, isocyanurates of isophorone diisocyanate, 1,6-hexamethylene diisocyanate, isocyanurates of 1,6-hexamethylene diisocyanate, 1,4-cyclohexane diisocyanate, p-phenylene diisocyanate, and triphenylmethane 4,4',4"-triisocyanate, tetramethyl xylene diisocyanate, metaxylene diisocyanate, and polyisocyanates. Examples of polyol cross linkers include polyvinyl alcohol, polyester polyols, and polyether polyols. Examples of melamine cross linkers include methylated melamine, mixed ether melamine, and butylated melamine.

In any of the exemplary embodiments, the cross-linker is applied to the non-woven mat alone, without any additional ingredients or components. Surprisingly, only a small amount of cross-linker needs to be applied to the non-woven mat in order to create the protective shell. In one or more exemplary embodiments, the cross-linker is applied to the non-woven mat in an amount that is no greater than 5.0 $g/m^2$, including no greater than 4.0 $g/m^2$, no greater than 3.0 $g/m^2$, no greater than 2.0 $g/m^2$, and no greater than 1.0 $g/m^2$. In some exemplary embodiments, the cross-linker is applied to the non-woven mat in an amount that is less than 1.0 $g/m^2$. In some exemplary embodiments, the cross-linker may be applied to the non-woven mat in an amount between 0.005 $g/m^2$ and 1.0 $g/m^2$, including between 0.01 $g/m^2$ and 0.5 $g/m^2$, between 0.03 $g/m^2$ and 0.3 $g/m^2$, and between 0.05 and 0.2 $g/m^2$.

The cross-linker is applied as a separate application and not added to the binder composition in order to achieve the hot-wet tensile retention improvements detailed herein. The cross-linker may be applied to the non-woven mat via impregnation application, or by other known application methods, such as spray, slot die coating, roller coating, and the like.

The application of the cross-linker to the non-woven mat modifies the hydrophobicity of the mat, causing the mat to change from being hydrophilic to at least substantially hydrophobic. The hydroxyl groups on the binder surface causes the non-woven mat to be hydrophilic. However, when the cross-linker is applied, the hydroxyl groups are eliminated, which modifies the mat's hydrophobicity, making the mat at least substantially hydrophobic. (See FIG. 1).

The application of a small amount of cross-linker to the non-woven mat demonstrates a hot-wet tensile strength retention improvement from about 0% (without the added cross-linker) to at least about 25%. In some exemplary embodiments, the hot-wet tensile strength retention of the cross-linked non-woven mats is at least 30%, including at least 32%, at least 35%, at least 40%, at least 45%, and at least 50%.

Figure 2:
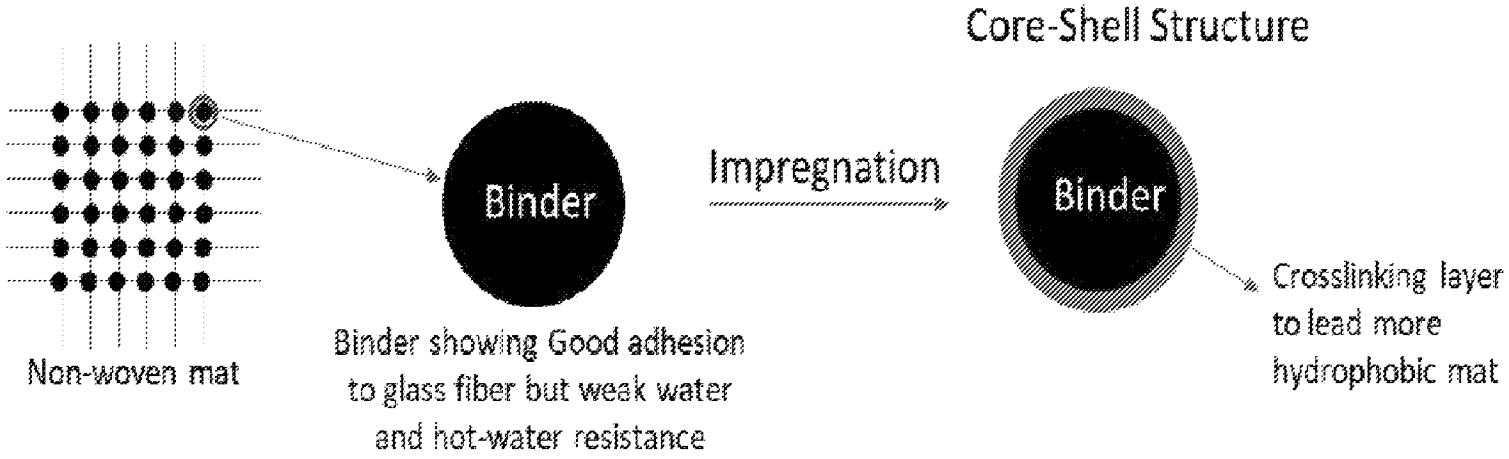
FIG. 2 shows an illustration of another exemplary aspect of the core/shell binder combination, in principle.

In any of the exemplary embodiments, the cross-linker may be applied in the form of a cross-linkable coating composition that may be applied to the non-woven mat by any known coating application method, such as impregnation. FIG. 2 illustrates a coating layer formed by application of a cross-linkable coating composition to a non-woven mat. The cross-linkable coating composition forms a core-shell structure with the cross-linkable coating composition as the shell and the binder resin as the core.

Table 1 provides an exemplary recipe for such a cross-linkable coating composition:

TABLE 1

| Components | Percentages (wt. %) | Exemplary Chemistries |
|---|---|---|
| Binder resin ("secondary binder") | 70-90% | Acrylics, polyurethanes, polyesters |
| Cross-linker | 5-30% | If cross-linking to hydroxyl groups: Polyols, isocyanates, melamines. If cross-linking to carboxylic acid groups: aziridines, melamine, carbodiimids, polyols. |
| Optional additives | 0-5% | Silicones, fluoropolymers, light stabilizers. |

In any of the embodiments, the amount of cross-linker present in the cross-linkable coating composition may be from about 5% to about 30%, in other embodiments from about 10% to about 20%, in other embodiments from about 12% to about 17%, in other embodiments, about 13% to about 15%, based on the weight of the total solids in the cross-linkable coating composition.

In addition to the cross-linker, the cross-linkable coating composition includes one or more binder resins (hereinafter referred to as a "secondary binder"). In some exemplary embodiments, the secondary binder comprises an acrylic, polyurethane, polyester, or mixtures thereof. Examples of suitable preferred commercially available acrylics include Joncryl® 1982, Joncryl® 1987, Joncryl® 2970, Joncryl® 8383, Joncryl® 540, Joncryl® 1540, Luhydran® A 848 S, QRXP 1629S, Acrodur™ DS3515, Acrodur™ 950L from BASF; Aquaset 100, QR-1629 from Dow chemical; Plextol BV 411, Plextol DV 455 and Plextol DV 585 from Synthomer.

In any of the exemplary embodiments, the amount of secondary binder present in the cross-linkable coating composition may be from about 70% to about 95%, in other embodiments from about 75% to about 92%, in other embodiments from about 80% to about 90%, in other embodiments from about 82% to about 87%, based on the weight of the total solids in the cross-linkable coating composition.

In any of the exemplary embodiments, the cross-linker has been pre-mixed with the binder resin. In such cases additional cross-linker is not necessary, although additional cross-linker may optionally be included.

Similar to the binder composition, the cross-linkable coating composition may include additives, including but not limited to, dyes, coupling agents, fillers, thermal stabilizers, antioxidants, wetting agents, colorants, silicones, fluoropolymers, light stabilizers, catalysts, etc. In any of the exemplary embodiments, the amount of additives present in the cross-linkable coating composition may be from about 0% to about 5.0%, in other embodiments from about 0.1% to about 2.5%, in other embodiments from about 0.5% to about 2.0%, in other embodiments from about 0.7% to about 1.8% based on the weight of the total solids in the cross-linkable coating composition.

In any of the exemplary embodiments, the application of the cross-linkable coating composition to the non-woven mats may improve the hot-wet tensile strength retention from about 19% (without the added cross-linker) to at least about 50%. In any of the exemplary embodiments, the hot-wet tensile strength retention of the cross-linked non-woven mats may be at least 60%, including at least 65%, at least 70%, at least 75%, at least 80%, and at least 85%.

In any of the exemplary embodiments, the total binder weight in the non-woven mat (including binder composition and secondary binder) may be between about 4.0-25.0 g/m$^2$, including about 14.0 to about 15.0 g/m$^2$. As the cost of the binder composition is generally less than the secondary binder, minimizing the add-on weight of the secondary binder is important. It has been discovered that in order to achieve a hot-wet retention of at least 25%, the minimum add-on weight of the secondary binder should be between about 1 and 10 g/m$^2$, including between 4 and 5 g/m$^2$.

FIG. 1 illustrates an exemplary cross-linking reaction schematic, wherein the core binder composition is a polyvinyl-alcohol-based binder and as the polyvinyl alcohol resin accumulates at the intersection of glass fibers during non-woven mat production, a certain amount of hydroxyl groups are present at the surface of the polymer. The addition of the cross-linker (whether independently or by way of a coating composition) links with the hydroxyl groups, improving the hot-wet resistance of the cross-linked mat due to the hydrophobicity and thermal-setting properties of the cross-linkable layer.

As discussed above, the application of at least one cross-linker to a non-woven fiber mat comprising a core binder composition improves the mat's resistance to moisture. This resistance to moisture is shown by reduced moisture absorption, at least as compared to a comparable nonwoven fiber mat prepared using a formaldehyde-free binder system alone (same basis weight and percent solids but without the subsequent application of a cross-linker). Due to the enhanced resistance to moisture, the cross-linked non-woven mats demonstrate improved hot-wet tensile strength retention ("hot" meaning a high temperature of 80° C. and "wet" meaning water). An estimate of the long-term performance of shingles is typically determined in the industry by obtaining the hot-wet tensile strengths of the non-woven mats forming the shingles. It is believed that the hot-wet tensile strength performance of the non-woven mat correlates to the performance of the shingle. For example, an increase or improvement in the hot-wet tensile strength results in an increase or improvement in the long-term performance in the shingle, whereas a decrease in the hot-wet tensile strength results in a decrease in the performance of the shingle.

In accordance with certain embodiments, the cross-linked nonwoven mats of the present disclosure maintain sufficient tensile strength that is comparable to a nonwoven fiber mat prepared using a binder system alone (same basis weight and percent solids but without the subsequent application of a cross-linker).

The cross-linked nonwoven fiber mats of the present disclosure have a basis weight of about 60 to about 95 g/m$^2$, including about 70 to about 90 g/m$^2$, and about 73 to about 86 g/m$^2$.

Having generally introduced the general inventive concepts by disclosing various exemplary embodiments thereof, a further understanding can be obtained by reference to certain specific examples illustrated below which are provided for purposes of illustration only and are not intended to be all inclusive or otherwise limiting of the general inventive concepts.

EXAMPLES

Example 1

Non-woven mats for use in gypsum applications were made by a conventional wet laid process in which chopped glass fibers, after being deposited onto a moving screen in the form of an aqueous slurry, were coated with an aqueous dispersion of a polyvinyl alcohol-based binder composition and then dried and cured. The non-woven mats had a basis weight of 70 g/m$^2$ and a loss on ignition (LOI) of 17%. A water-born isocyanate resin was used as the cross-linker and an aqueous solution of the cross-linker was applied to the non-woven mat by impregnation. After impregnation, the samples were dried at 210° C. for 2 minutes by Mathis dryer, forming a cross-linked non-woven mat. For the control samples, non-woven mats were impregnated with water and then dried at the same conditions. The machine-direction (MD) tensile strengths and hot-wet strengths (measured by machine-direction tensile strengths after the mat is soaked in 80° C. aqueous solution for 10 min.) were measured and listed below in Table 2.

TABLE 2

| | Control | Sample 1 | Sample 2 | Sample 3 |
|---|---|---|---|---|
| Method to apply Isocyanate | Impregnation | Impregnation | Impregnation | Impregnation |
| Isocyanate (g/m$^2$) | 0 | 0.05 | 0.10 | 0.20 |

TABLE 2-continued

| | Control | Sample 1 | Sample 2 | Sample 3 |
|---|---|---|---|---|
| Isocyanate/PVOH ratio | 0:100 | 0.5:100 | 0.9:100 | 1.7:100 |
| MD Tensile (N/50 mm) | 309.67 | 302.75 | 316.70 | 320.58 |
| Hot-Wet Tensile (N/50 mm) | 0 | 81.51 | 102.37 | 101.63 |
| Hot-Wet Retention | 0% | 26.9% | 32.3% | 31.7% |

As illustrated above in Table 2, the MD tensile strengths remained at a similar level for all samples, but the Control broke into pieces during hot-wet testing, thus it's hot-wet retention was zero percent. Add-on weights of isocyanate cross-linker in Samples 1-3 were 0.05 g/m$^2$, 0.1 g/m$^2$, and 0.2 g/m$^2$, respectively, which are considered trace amounts compared to PVOH binder weight. However, each of Samples 1-3 demonstrated significant hot-wet retention improvements compared to the Control, ranging from 26.9% to 32.3%.

Example 2

TABLE 3

| | Control | Sample 2 | Sample 4 | Sample 5 |
|---|---|---|---|---|
| Method to apply Isocyanate | Impregnation | Impregnation | Adding to binder solution | Adding to binder solution |
| Isocyanate (g/m$^2$) | 0 | 0.10 | 0.12 | 0.72 |
| Isocyanate/PVOH ratio | 0:100 | 0.9:100 | 1.0:100 | 6.1:100 |
| MD Tensile (N/50 mm) | 309.67 | 316.70 | 313.61 | 320.28 |
| Hot-Wet Tensile (N/50 mm) | 0 | 102.37 | 17.32 | 35.53 |
| Hot-Wet Retention | 0% | 32.3% | 5.5% | 11.1% |

For comparison purpose, we also applied the same water-born isocyanate resin cross-linker by directly adding it into binder composition used to form the non-woven mat instead of by impregnation. (See Table 3, above). Sample 4 was formed by adding 0.12 g/m$^2$ of isocyanate resin directly into the binder composition used to form the non-woven mat. Sample 5 was prepared by adding about 0.72 g/m$^2$ of the water-born isocyanate resin cross-linker directly into the binder composition used to form the non-woven mat. Control sample and Sample 2 from Table 2 have been used for comparison. The hot-wet strengths were measured and the control, demonstrated no hot-wet tensile retention, Sample 2 demonstrated a hot-wet tensile retention of 32%, Sample 4 demonstrated a hot-wet tensile retention of 5.5%, and Sample 5 demonstrated a hot-wet retention of 11%. Thus, the core-shell structure created by adding the cross-linker to the non-woven mat via impregnation provided significantly better hot-wet performance than is achieved when the cross-linker is added to the binder composition.

Example 3

Non-woven mats were made by a conventional wet laid process in which chopped glass fibers, after being deposited onto a moving screen in the form of an aqueous slurry, were coated with an aqueous dispersion of a starch-based binder composition (also referred to as a precursor binder or "core") and then dried and cured. The mats were made with 1.375" M fiber (16 micrometer diameter) and cured at 230° C. A cross-linking coating layer (referred to as "shell") was applied to the non-woven mat by impregnation. After impregnation, the samples were dried at 210° C. for 2 minutes by Mathis dryer. The non-woven mats had a glass weight of 71 g/m$^2$ and the total binder weight (core+shell) for all samples are at 14.5 g/m$^2$. Table 4 lists the weight ratios between the core and the shell and shows the distribution of total binder between core and shell. The weight ratios between "core" and "shell" are all at 50:50 (or 1:1) in Table 4. The tensile index is defined as: TI=(Total Tensile)/(BW×LOI), where total tensile=(MD tensile+CD tensile); BW=basis weight; and LOI=loss on ignition.

TABLE 4

| | Sample 6 | Sample 7 | Sample 8 | Sample 9 |
|---|---|---|---|---|
| Precursor binder (core) | Starch based binder | Starch based binder | Starch based binder | Starch based binder |
| Coating Chemistry (shell) | N/A | Acrylic/ Isocyanates | Acrylic/ Melamine | Self-cross linking |
| Weight ratio between core and shell | 100:0 | 50:50 | 50:50 | 50:50 |
| HW retention | 19.8% | 71.9% | 73.9% | 79.0% |
| Tensile Index | 315.2 | 290.8 | 264.0 | 326.9 |

As illustrated above, the hot-wet retention significantly increased from 19.8% (Sample 4) without shell coating to >70% (Sample 5 to 7) with shell coating for all coating chemistries.

Example 4

TABLE 5

| | Sample 4 | Sample 10 | Sample 11 | Sample 7 |
|---|---|---|---|---|
| Precursor binder (core) | Starch based binder | Starch based binder | Starch based binder | Starch based binder |
| Coating Chemistry (shell) | N/A | Self-cross linking | Self-cross linking | Self-cross linking |
| Weight ratio | 100:0 | 80:20 | 70:30 | 50:50 |

TABLE 5-continued

| | Sample 4 | Sample 10 | Sample 11 | Sample 7 |
|---|---|---|---|---|
| between core and shell | | | | |
| HW retention | 19.8% | 57.4% | 68.4% | 79.0% |
| Tensile Index | 315.2 | 342.0 | 311.8 | 326.9 |

Figure 3:
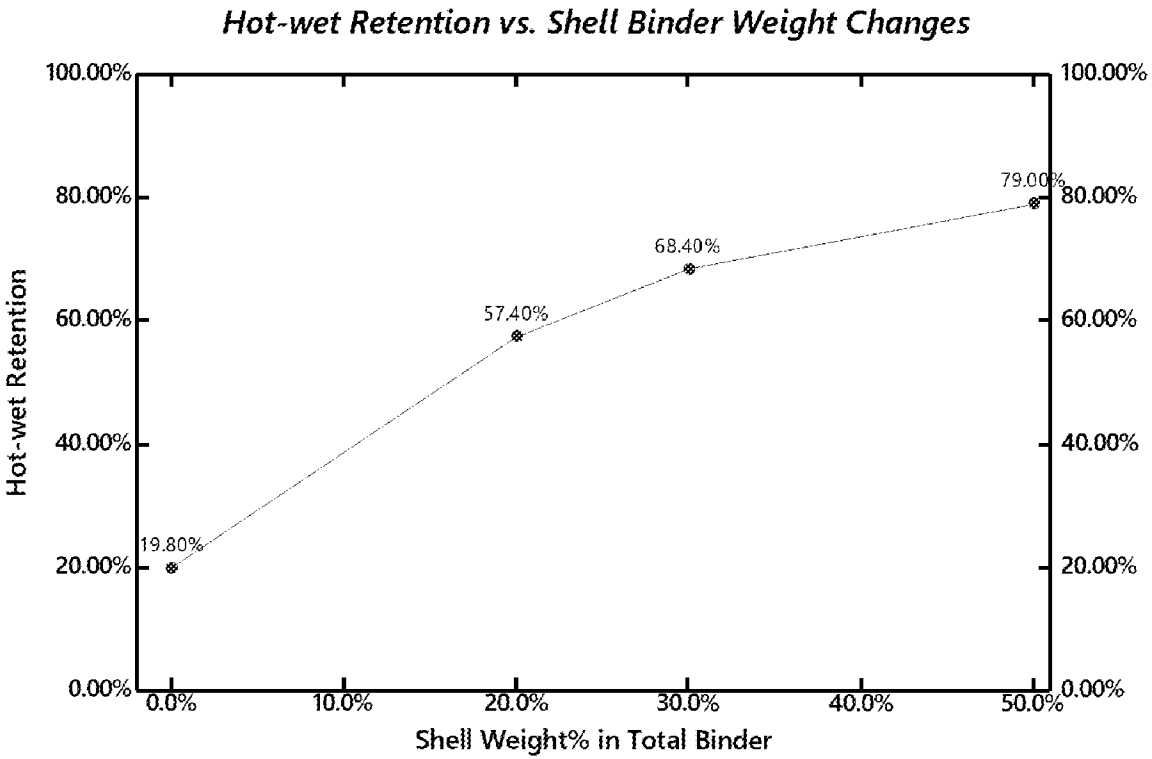
FIG. 3 graphically illustrates the hot-wet retention of a cross-linked nonwoven mat with increasing shell binder weight.

The self-cross linking option in coating chemistry (exemplified in Table 4) was then selected because of its highest tensile index. Core-shell cross-linked mats formed therewith were tested for hot-wet retention vs. core/shell binder weight ratio change. As illustrated in Table 5, the percentage of shell binder gradually increased from 0% to 50% in total binder (core+shell) composition. The glass weight and total binder weight remained at 71 g/m$^2$ and 14.5 g/m$^2$, respectively. The hot-wet retentions increase as the shell binder weight percentage increases and surpass 65% when the shell weight percentage is 30% of total binder (FIG. 3).

Figure 4:
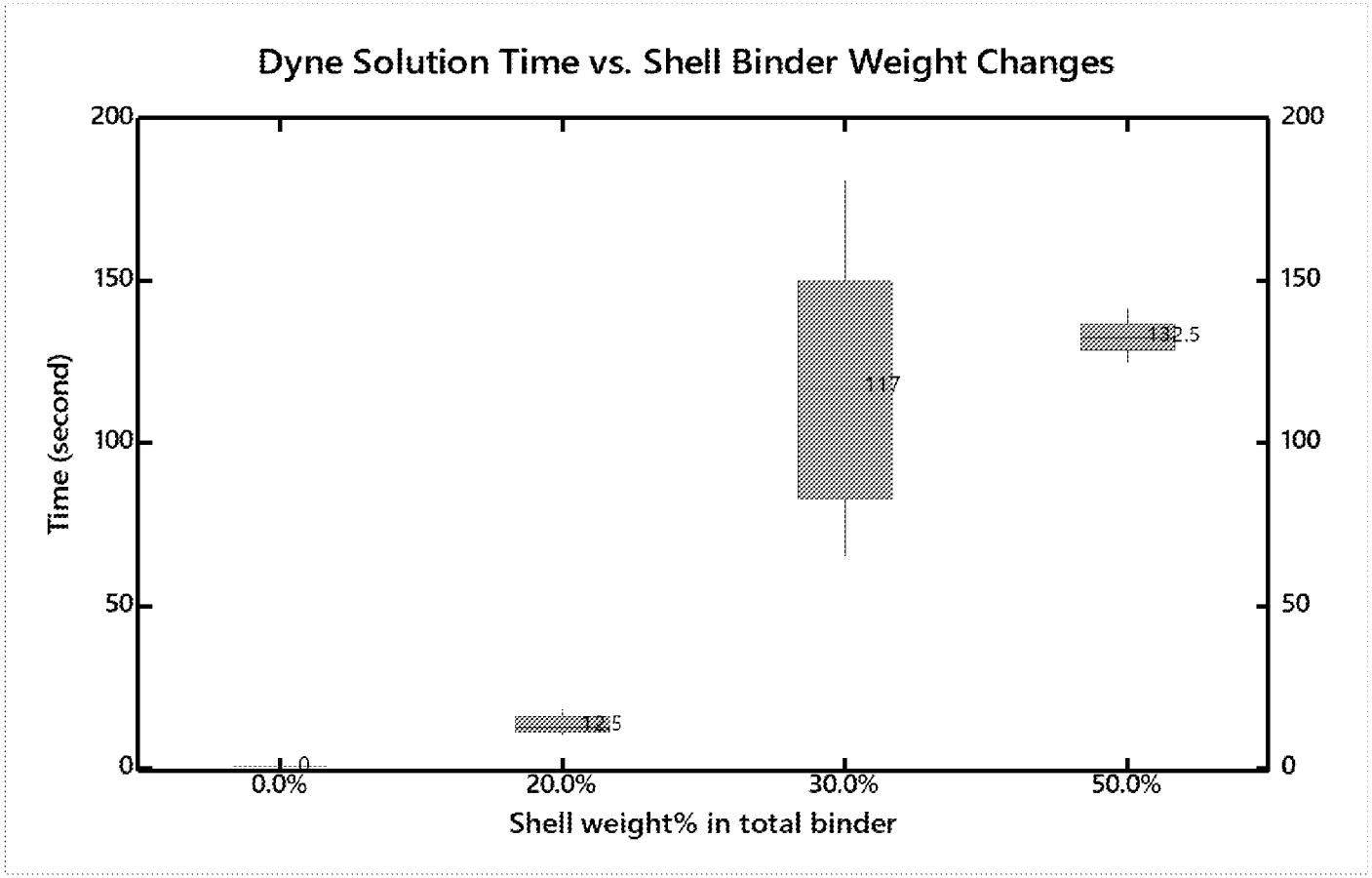
FIG. 4 graphically illustrates the Dyne repellency of exemplary cross-linked nonwoven mats with varying shell binder weight.

Mats coated with the self-crosslinking chemistry were further tested for the Dyne solution time vs. the shell binder weight change. A Dyne solution is a mix of ethanol (33% by volume) and water (67% by volume). The testing method comprised gently depositing a drop of dyne solution on the top of a veil surface. The time (in seconds) it takes for the drips to wick into the veil surface is measured and the longer time that passes, the better hydrophobicity for the veil. FIG. 4 illustrates the results for a Dyne solution wick test for various samples. Samples with higher shell binder weight percentage demonstrate better water/dyne solution resistance.

Figure 5:
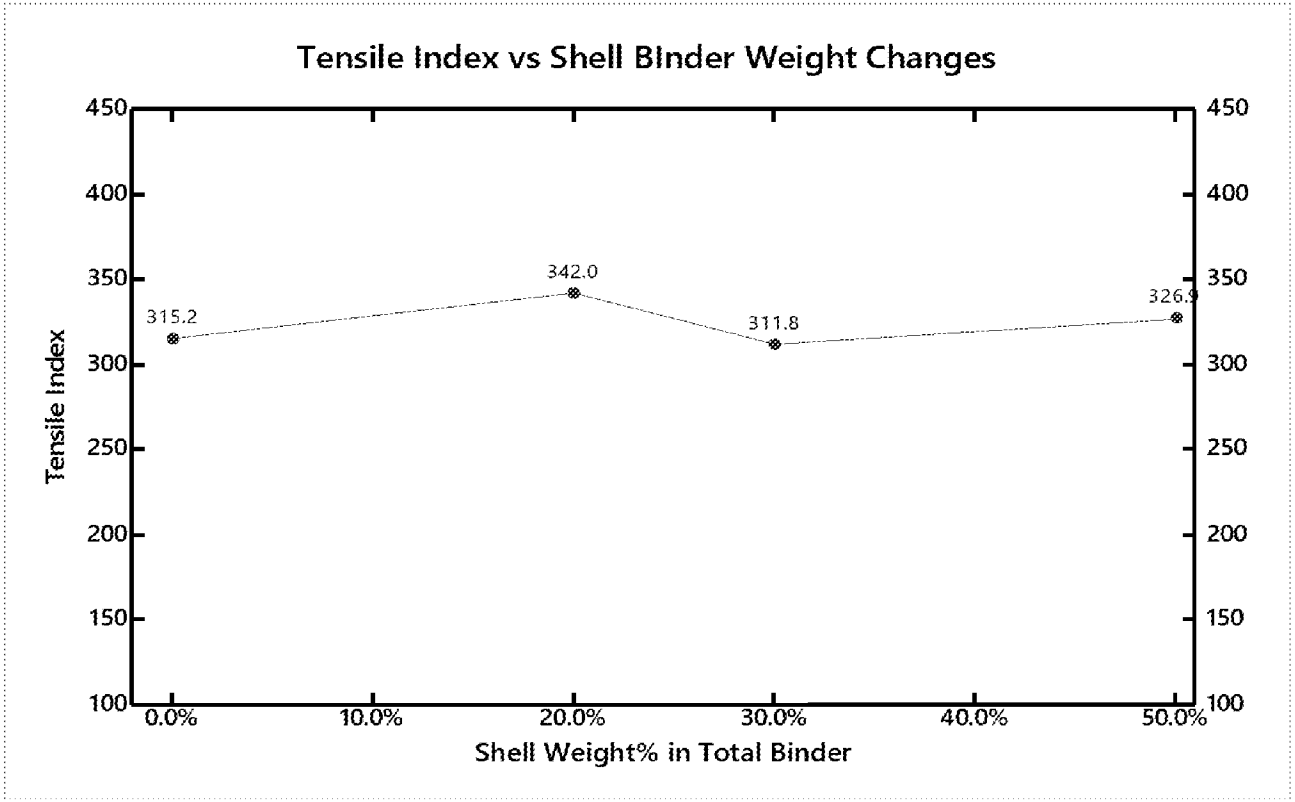
FIG. 5 graphically illustrates the tensile index of exemplary cross-linked nonwoven mats with varying shell binder weight.

Additionally, as shown in FIG. 5, the shell binder weight changes give limited impact to tensile indexes. Thus, the tensile indexes do not substantially change with shell weight % variations in total binder composition.

All percentages, parts and ratios as used herein, are by weight of the total composition, unless otherwise specified. All such weights as they pertain to listed ingredients are based on the active level and, therefore, do not include solvents or by-products that may be included in commercially available materials, unless otherwise specified.

All references to singular characteristics or limitations of the present disclosure shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more (e.g., 1 to 6.1), and ending with a maximum value of 10 or less (e.g., 2.3 to 9.4, 3 to 8, 4 to 7), and finally to each number 1, 2, 3, 4, 5, 6, 7, 8, 9, and 10 contained within the range.

The compositions and corresponding manufacturing methods of the present disclosure can comprise, consist of, or consist essentially of the essential elements and limitations of the disclosure as described herein, as well as any additional or optional ingredients, components, or limitations described herein or otherwise useful in non-woven mat applications.

The compositions of the present disclosure may also be substantially free of any optional or selected essential ingredient or feature described herein, provided that the remaining f composition still contains all of the required ingredients or features as described herein.

While the invention has been illustrated and described in detail in the drawings and foregoing description, the same is to be considered as illustrative and not restrictive in character. It should be understood that only the exemplary embodiments have been shown and described and that all changes and modifications that come within the spirit of the invention are desired to be protected.

The invention claimed is:

1. A cross-linked nonwoven fibrous mat comprising:

a core layer including a precursor mat comprising a plurality of fibers bound with a formaldehyde-free core binder composition having hydroxyl or carboxylic acid functional groups, wherein the plurality of fibers comprises one or more of glass fibers, mineral fibers, and ceramic fibers; and a protective coating composition disposed on at least one surface of the core layer, wherein the protective coating composition comprises a cross-linker comprising one or more of isocyanate and melamine functional groups;

wherein the hydroxyl or carboxylic acid functional groups on the at least one surface of the core layer cross-link with the cross-linker in the coating to form a shell layer, and wherein the cross-linked nonwoven mat has a hot-wet retention of at least 25%.

2. The cross-linked non-woven fibrous mat of claim 1, wherein the fibers have an average diameter of about 3 microns to about 20 microns.

3. The cross-linked non-woven fibrous mat of claim 1, wherein the core binder composition comprises a polyhydroxy component that is present in an amount from about 30% to about 95% by weight, based on the weight of the total solids in the binder composition.

4. The cross-linked non-woven fibrous mat of claim 1, wherein the cross-linker is selected from the group consisting of toluene diisocyanate (TDI), isocyanurates of toluene diisocyanate, diphenylmethane 4,4'-diisocyanate, isocyanurates of 4,4'-diisocyanate, methylenebis-4,4'-isocyanatocyclohexane, isophorone diisocyanate, isocyanurates of isophorone diisocyanate, 1,6-hexamethylene diisocyanate, isocyanurates of 1,6-hexamethylene diisocyanate, 1,4-cyclohexane diisocyanate, p-phenylene diisocyanate, and triphenylmethane 4,4',4"-triisocyanate, tetramethyl xylene diisocyanate, metaxylene diisocyanate, and polyisocyanates.

5. The cross-linked non-woven fibrous mat of claim 1, wherein the cross-linker is selected from the group consisting of methylated melamine, mixed ether melamine, and butylated melamine.

6. The cross-linked non-woven fibrous mat of claim 1, wherein the cross-linker is present in an amount between about 0.005 g/m$^2$ and about 5.0 g/m$^2$.

7. The cross-linked non-woven fibrous mat of claim 1, wherein the protective coating composition comprises a secondary binder composition, wherein the core binder composition and the secondary binder composition provide a total binder weight between about 4.0 and about 25.0 g/m$^2$.

8. The cross-linked non-woven fibrous mat of claim 1, wherein the cross-linked nonwoven mat has a hot-wet retention of at least 30%.

* * * * *